United States Patent [19]

Garlinghouse

[11] 4,095,288

[45] June 13, 1978

[54] VARIABLE AGITATOR MIXER

[76] Inventor: Leslie H. Garlinghouse, 1585 Sierra Madre Villa, Pasadena, Calif. 91107

[21] Appl. No.: 774,193

[22] Filed: Mar. 3, 1977

Related U.S. Application Data

[63] Continuation of Ser. No. 575,141, May 7, 1975, abandoned, Ser. No. 340,670, Mar. 13, 1973, abandoned, and Ser. No. 364,881, May 29, 1973, Pat. No. 3,962,892.

[51] Int. Cl.[2] ..... B01F 13/00

[52] U.S. Cl. ..... 366/219; 366/343

[58] Field of Search ..... 259/3, 4, 72, 75, 48, 259/54, 56, 99, 100, 108, 107; 241/89.3; 404/133, 123; 68/21, 23, 152

[56] References Cited

U.S. PATENT DOCUMENTS

| | | | |
|---|---|---|---|
| 1,735,393 | 11/1929 | Hiller | 259/3 |
| 2,265,516 | 12/1941 | Chayie | 68/171 |
| 3,015,188 | 1/1962 | Reinecker | 99/483 |
| 3,132,848 | 5/1964 | Garlinghouse | 259/72 |
| 3,503,085 | 3/1970 | Groebli | 68/21 |
| 3,738,616 | 6/1973 | Copeland | 259/108 |
| 3,807,201 | 4/1974 | Gorsuch | 68/23 |

*Primary Examiner*—Robert W. Jenkins

[57] ABSTRACT

An agitator mixer for an oscillatory type mixer has a container for material to be mixed consisting of an upper rigid section and a lower flexible section of comparable capacities. A rigid flat disc at the bottom of the flexible section is connected to a motor-driven wobble head which sets up an oscillating wobble motion in the disc resulting in a churning action in the flexible section. A connection at the center of the disc comprises a releasable attachment for an auxiliary agitator provided with appendages, some of which may be flexible, which are flung about in oscillatory paths in both the flexible section and the rigid section to increase the churning effect.

6 Claims, 7 Drawing Figures

FIG. 6.
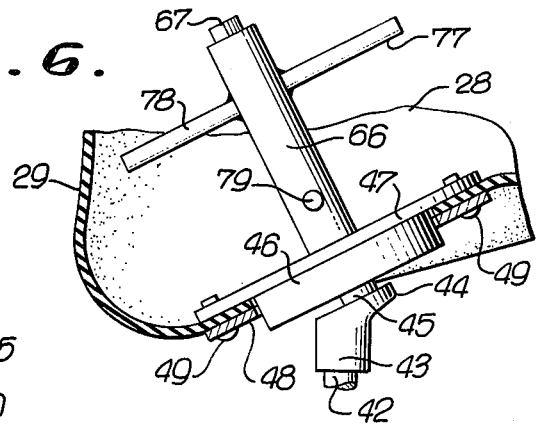
FIG. 3.
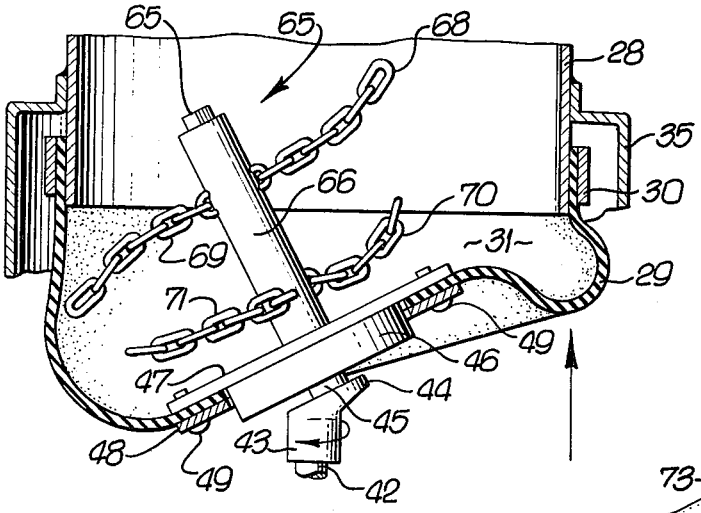
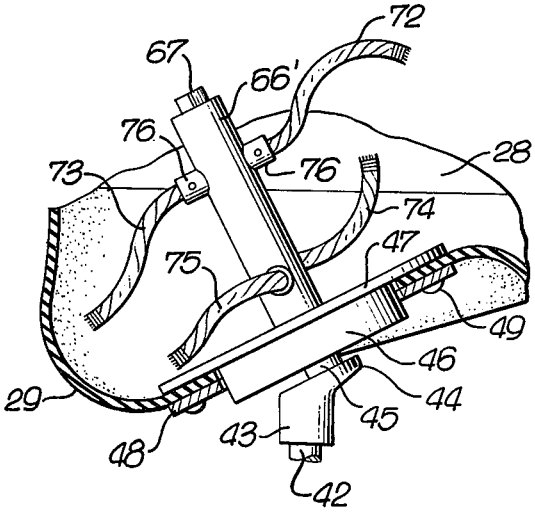
FIG. 5.
FIG. 4.
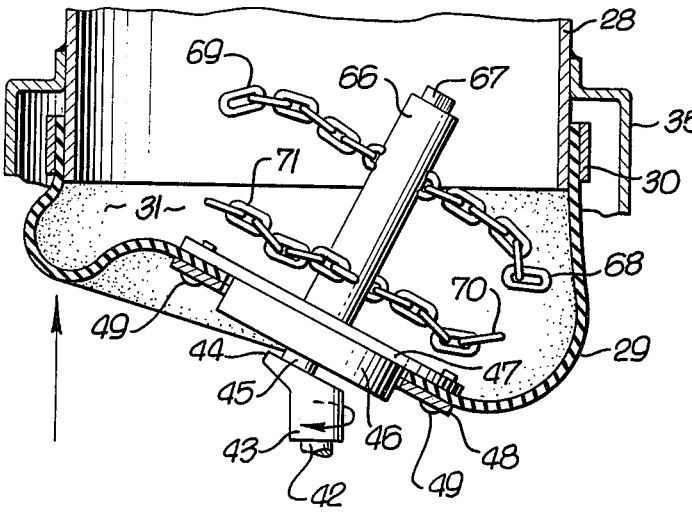
FIG. 7.
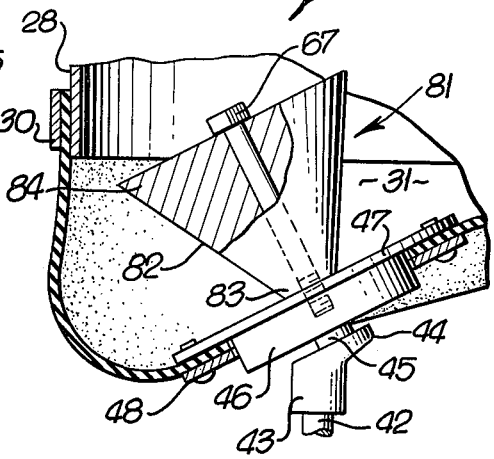

VARIABLE AGITATOR MIXER

This is a continuation of copending applications Serial No. 575,141 filed May 7, 1975, now abandoned; Serial No. 340,670 filed March 13, 1973, now abandoned; and Serial No. 364,881 filed May 29, 1973, now Patent No. 3,962,892.

Patents which show an oscillating wobble drive similar to that made use of in the present invention include U.S. Pat. Nos. 2,854,222; 2,856,133; 2,900,883; 2,917,979; 3,132,848; and 3,673,931.

Quite commonly, washing devices for fabrics, and in fact a great variety of materials, depend upon a container capable of being rotated, the container being provided with vanes or baffles of some kind to churn the liquid in order to bring it into contact with the material being washed as thoroughly as possible. When liquids are to be mixed, the same general approach usually is followed, namely the preparation of some type or other of rotary agitating means. On occasions such containers have been so set up mechanically as to reverse motion back and forth to further increase churning and turbulence. In still other types of devices, jets of liquid alone projecting in one direction or another are on occasion depended upon for mixing liquids. Paddle wheels and propellers are, of course, a commonly used expedient.

Whenever a washer or mixer needs to be provided with a relatively large number of baffles, paddle wheels, propeller vanes and the like, there is constantly the problem of cleaning such devices after the machine has operated for awhile. There must always be a thorough cleaning if one mix is to be followed by another of different kind. A great number and assortment of vanes, paddle wheels, propellers and the like add to the power needed for operation and also add appreciably to the expense of building, installation and maintenance.

It is therefore among the objects of the invention to provide a new and improved mixer-type device which is provided with two chambers of different character and comparable capacity and equipped with a readily variable operating agitator operable in both chambers which can be removed for replacement or for the substitution of a different type of agitator when a different type of washing or mixer operation is to be encountered.

Another object of the invention is to provide in a wobble-type oscillating flexible mixing container, an agitator which is so mounted with relation to the wobble drive as to reach into the reservoir of liquid which is to be agitated, either for washing or mixing, in such fashion as to greatly improve the churning effect.

Still another object of the invention is to provide in a wobble-type oscillating flexible mixing container agitators of different types wherein flexible appendages are made use of which as a result of the basic oscillating wobble motion are flailed and, in effect, whip-lashed through the liquid thereby to create a greater than average churning effect so that a thorough washing or mixing can be accomplished in much less time.

Also included among the objects of the invention is to provide in an oscillating wobble-type mixing chamber, a removable agitator assembly which can be quickly mounted in position and as quickly and readily removed whenever a different type of churning action might be desirable, without need for disturbing the mixer in any other fashion.

With these and other objects in view, the invention consists in the construction, arrangement, and combination of the various parts of the device, whereby the objects contemplated are attained, as hereinafter set forth, pointed out in the appended claims and illustrated in the accompanying drawings.

In the drawings:

FIG. 3 is a fragmentary longitudinal sectional view of the flexible portion of the container equipped with a different type of agitator assembly.

FIG. 4 is a fragmentary longitudinal sectional view similar to FIG. 3 but showing the device in a different position.

FIG. 5 is a fragmentary longitudinal section view of still another form of agitator making use of flexible appendages.

FIG. 6 is a fragmentary longitudinal sectional view of an agitator assembly making use of rigid appendages.

FIG. 7 is a fragmentary longitudinal sectional view of the flexible portion of the device making use of a rigid agitator assembly of still another form.

Figure 2:
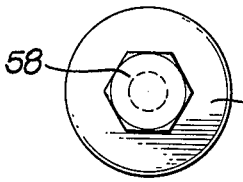
FIG. 2 is a plan view of the agitator taken on the line 2—2 of FIG. 1.

In an embodiment of the invention chosen for the purpose of illustration there is shown a frame indicated generally by the reference character 10 mounted on a supporting base 11, the frame consisting of a base plate 12 on which are columns 13 and 14 with respective diagonal stiffener braces 15 and 16 attached to a cross-beam 17 adjacent the bottom.

A tilting carriage including a bottom plate 20, side plates 21 and 22 and a top plate 23 is pivotally mounted by means of pivot shafts 24 and 25 at the tops of the respective columns 13 and 14. A handle 26 is employed for tilting the carriage when the need arises.

A two-part container indicated generally by the reference character 27 consists of a cylindrical upper rigid section 28 and a lower flexible section 29. The upper edge of the flexible section is fastened to the lower edge of the rigid section by means of a band 30. The rigid section and flexible section acting together provide a chamber 31 which can be closed by means of a cover 32 sealed in place when required by means of a seal 33.

On some occasions there may be provided a jacket 35 surrounding the lower flexible section and providing a sealed chamber 36. To satisfy some special requirements, there may be provided a tubing line 37 with one branch 38 communicating with the chamber 31 in the area of the rigid section 28 and a branch line 39 in communication with the sealed chamber 36. Either a low pressure or vacuum condition may thus be applied or a high pressure condition as the case suggests.

In order to provide an oscillating wobble motion to the lower flexible section 29, a motor 40 is slung beneath the bottom plate 20, the motor being provided with a gear reducing unit 41 from which is driven a shaft 42 at the top of which is a fitting 43 with an angularly offset projection 44. Extending angularly upwardly from the offset projection 44 is a wobble shaft 45 which is rotatably mounted in a rigid disc 46. An inner plate 47 substantially integral with the disc 46 has an annular washer 48 bolted to it by means of bolts 49 whereby to clamp an annular portion 50 of the flexible section 29 and seal it in position.

A rotating packing seal 51 is held in place by a packing ring 52 whereby to provide a rotating seal for the shaft 42.

Figure 1:
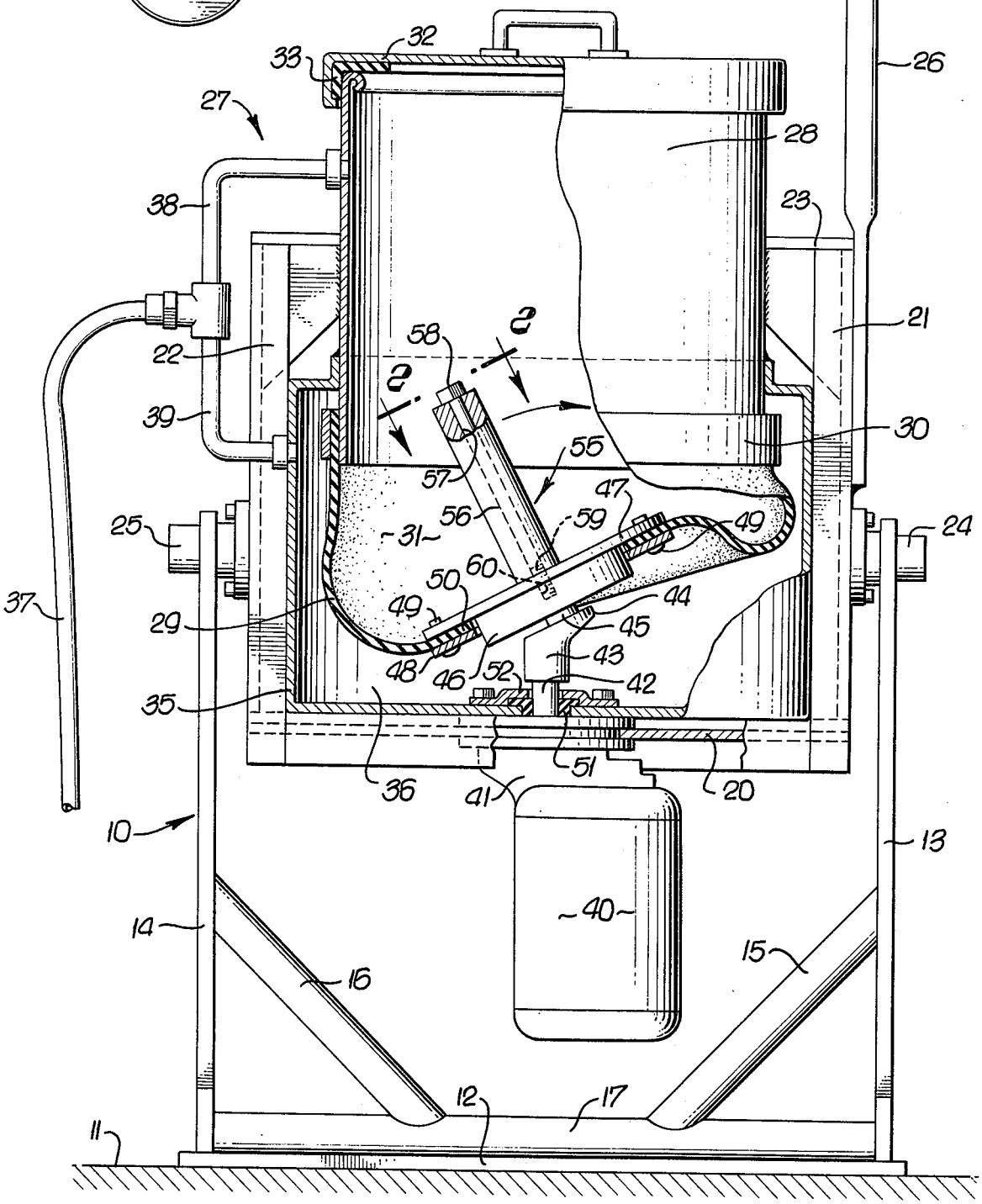
FIG. 1 is a longitudinal sectional view of one form of composite container in which a relatively simplified version of removable agitator is mounted.

Of special moment is the provision of an agitator assembly indicated generally by the reference character 55 which, in the form of invention of FIG. 1, consists of a post 56 through which extends a central bore 57 providing an opening through which a bolt 58 extends so that its threaded end 59 can threadedly engage a threaded recess 60 in the disc 46.

In the form of invention of FIG. 3 there is provided a different agitator assembly 65. This assembly is built around a post 66, secured to the disc 46 by means of a bolt 67 as described in connection with the agitator assembly 55. On the upper portion of the post 66 is a pair of appendages 68 and 69. A second pair of appendages 70 and 71 is likewise secured to the post 66 at a location more nearly approaching the disc 46, the appendages 70 and 71 being displaced 90 degrees with respect to the appendages 68 and 69. The agitator assembly 65 can be removed by merely disengaging the bolt 67.

In the form of device of FIG. 5 the appendages 68, 69, 70 and 71, which are illustrated as flexible chains, are supplanted by flexible cable appendages 72, 73, 74 and 75. Collars 76 anchored to the post 66' may be used for fastening the cable appendages to the post. The bolt 67 is again used in the same fashion to secure the agitator assembly to the disc and to enable its removal therefrom.

In the form of invention of FIG. 6, stiff rod appendages 77, 78 and 79 are rigidly mounted on the post 66" by being welded thereto in position such that they extend transversely outwardly at about right angles with respect to the post.

Still another type of agitator assembly 81 is shown in FIG. 7. In this instance, there is provided a post 82 of special construction in that a base 83 of the post is of relatively small diameter and a top section 84 is of relatively large diameter. By making use of a geometric shape of this kind the top section 84 overhangs the bottom of the lower flexible section 29 to an appreciable extent. Although the post 82 is shown as frustoconical, a comparable effect can be secured with a somewhat mushroom type design for the post. Here again, to hold the post in position, use is made of the bolt 67 threadedly engaging the disc 46 in the same manner as has been previously described.

Although it is a great convenience to have the agitator assemblies removable for either washing or replacement by a different type of agitator, where the mixer is to be used for mixing only one type of easy cleaning material, some saving can be effected by making the agitator assembly non-removable.

In the operation of this device making use of any one or another of the agitator assemblies, the disc 46 and the plate 47 have given to them a distinctly oscillating wobble motion by rotation of the fitting 43. When this occurs, the top of the post describes an arc of appreciable radius within the chamber 31, thereby adding to the churning effect of the contents. When appendages like the flexible appendages of FIGS. 3 and 5 are used, these flexible appendages are flailed up and down and in a roughly circulatory path as well, due to the wobble action of the disc 46 imparting its motion to the post. In this manner the flexible appendages churn virtually throughout the entire space within the chamber 31 from one wall to the other. Longer appendages may be used when the wall of the chamber needs to be scraped clean. The rod appendages of FIG. 6 have a comparable motion without the flexible flailing.

The overhang of the top section 84 of the post 82 as shown in FIG. 7 has a somewhat different action on the liquid contents in that as the top section is oscillated, the sloping sidewall tends to push a portion of the liquid contents downwardly toward the bottom of the chamber 31, such portion of the liquid, after being pushed toward the bottom, ultimately turning and returning to the top along the inside walls of the lower flexible section 29, this action being repeated in what may be described as a soft mixing routine.

Although in the chosen embodiments the flexible appendages have been shown fastened to an upstanding rigid post, it will be appreciated that flexible appendages can when desired be fastened by conventional means to the plate 47 itself, at locations removed from the geometric center. So mounted, such flexible appendages will also be given a flailing motion whereby to churn and agitate the contents of the chamber 31.

In providing dual chamber sections 28 and 29 such as proposed, the material experiences two different modes of agitation. The lower section, being flexible, subjects the material to a very distinctive churning movement, some movement being imparted to the material by upward and downward wobbling of the flexible bottom and a progressive churning in the mid area produced by the agitating post, as in FIG. 1, or the laterally extending arms of FIGS. 3, 4, 5 and 6.

The upper section, identified as second chamber in the claims, is a chamber of capacity larger than the flexible chamber and capable of containing a correspondingly greater proportion of the material to be mixed.

As noted in the embodiment shown and described, the upper rigid section 28 has a capacity appreciably exceeding the capacity of the flexible section 29, the rigid section 28, also being of greater depth. The sections could, however, be of more or less the same capacity. What is of consequence is to have adjacent spaces for the material to be mixed wherein the material in one of the spaces is continuously subjected to one type of motion and agitation different from the other. The material does not, however, remain in one space or the other, but instead passes continuously from one space to the other in an ever-changing pattern of turbulence, aided at all times by the agitator assembly 55 in the case of FIG. 1 or other forms of the agitator as in FIGS. 3, 5, 6 and 7.

On those occasions when some solid material such as a powder or fiber is to be mixed into the charge in the chambers, it is advantageous to have the agitator assembly protrude well into the upper rigid section 28. At the same time, the liquid charge is made such that the liquid level is well above the top of the lower section 29, but low enough so that at least the appendages 68 and 69 of FIGS. 3 and 4, for example, are flung above the liquid level during operation. As a consequence, solid material deposited on the surface, even though it might be dry and not readily mixable, is beaten or folded into the liquid mass by the appendages. Action of the appendages, also being oscillatory in character, causes the appendage to ultimately reach into all portions of both the upper section 28 and the lower section 29.

It is significant to note that whether considering the post of FIG. 1, or the laterally extending elements of FIGS. 3 through 6 inclusive, all of the parts referred to act within the upper section inside the rigid upper wall portion to a degree at least as active as in the lower flexible section if not in fact more so.

With the upper section being formed by a rigid wall, motion imparted to the material in that section is that generated from either the post of FIG. 1 or the combined post and laterally extending elements of FIGS. 3 through 6 inclusive. Hence the mode of agitation of material in the upper section is always different and in contrast to the mode of agitation in the lower flexible section.

While the invention has herein been shown and described in what is conceived to be a practical and effective embodiment, it is recognized that departures may be made therefrom within the scope of the invention, which is not to be limited to the details disclosed herein but is to be accorded the full scope of the claims so as to embrace any and all equivalent devices.

Having described the invention, what is claimed as new in support of Letters Patent is as follows:

1. In an oscillatory type mixer employing a container for material to be mixed having a rigid upper wall portion, a flexible lower wall and bottom portion, said lower wall portion extending upwardly from said flexible bottom portion defining an inner first chamber of variable shape inside said container, said rigid upper wall portion forming a second chamber of fixed shape and size in axial alignment with the first chamber and having a capacity comparable to the capacity of said first chamber, said chambers having a common vertical axis, and an annular connection between said upper and lower wall portions lying in a plane transverse to the common axis of said portions, said chambers being adapted to receive a mixing charge filling said first chamber and extending into the second chamber to provide an exposed level of said charge above the top of said first chamber and within said second chamber, a rigid disc at the center of said flexible lower wall and bottom portion having an inwardly facing surface comprising a bottom for said first chamber and a motor-driven oscillatory wobble drive for said disc, said surface having a continuous tilt relative to said plane and a continuously varying wobble motion during operation, an agitator assembly having a relatively fixed end with an attachment to said rigid disc at a location substantially coincident with said surface, said agitator assembly having a length exceeding the depth of the first chamber and extending from the disc inwardly through the first chamber and into the second chamber through said plane and that portion of the mixing charge contained in said second chamber, said agitator assembly having a continuous tilt relative to said plane and a path of travel passing cyclically continuously into and out of those portions of the chambers which receive the mixing charge.

2. An oscillating type mixer as in claim 1 wherein there is a fastening means on the rigid disc and a releasable fastener on the agitator assembly having a releasable engagement with said fastening means and adapted to be removed for replacement.

3. An oscillating type mixer as in claim 1 wherein the agitator assembly comprises a central anchoring element mounted on said disc and a flexible appendage having an attachment at one end to the anchoring element at a location spaced intermediate the rigid disc and an opposite end of said anchoring element, the attachment of said appendage having a position during operation continuously shifting relative to a horizontal plane, said appendage having a free end extending into the first chamber, said appendage having a length exceeding the distance between the attachment and said opposite end whereby the free end of said appendage has a location within said second chamber during a portion of its movement and within said first chamber during another portion of its movement and travels an oscillatory path in which the distance between the flexible bottom and said appendage constantly varies.

4. An oscillating type mixer as in claim 3 wherein there is a plurality of appendages secured at one end to the central anchoring element and having free ends of said appendages protruding laterally outwardly.

5. An oscillating type mixer as in claim 3 wherein the agitator assembly comprises flexible appendages located at positions spaced laterally and axially from each other and from the rigid disc, said appendages having a fixed end secured to the central anchoring element, some of said appendages having a length exceeding the distance between the attachment and said opposite end whereby a free end of such appendages has a path of travel which extends into and out of said second chamber at a location overlying said disc and in an oscillatory path.

6. An oscillating type mixer as in claim 1 wherein the agitator assembly comprises a projection having a fixed end adjacent the disc and a free end with a transverse portion extending laterally outwardly to a location beyond the fixed end and overlying said disc, said projection having a part thereof extending into the first chamber and a part thereof extending into the second chamber.

* * * * *